United States Patent [19]

Miura et al.

[11] Patent Number: 4,618,311

[45] Date of Patent: Oct. 21, 1986

[54] VANE ANGLE CHANGING DEVICE FOR AN AXIAL FLUID MACHINE

[75] Inventors: Haruo Miura; Takashi Nagaoka; Yoshiaki Abe; Souji Sakata, all if Ibaraki, Japan

[73] Assignee: Hitachi, Ltd., Tokyo, Japan

[21] Appl. No.: 511,734

[22] Filed: Jul. 7, 1983

[30] Foreign Application Priority Data

Jul. 7, 1982 [JP] Japan ..... 57-116766

[51] Int. Cl.[4] ..... F04D 29/36

[52] U.S. Cl. ..... 415/149 R; 415/150; 415/162; 415/134

[58] Field of Search ..... 415/148, 149 R, 150, 415/159, 160, 162, 134; 74/89

[56] References Cited

U.S. PATENT DOCUMENTS 2,371,706 3/1945 Planiol ..... 415/149 R X
2,862,687 12/1958 Aguet et al. ..... 415/162

FOREIGN PATENT DOCUMENTS 1136350 9/1962 Fed. Rep. of Germany ..... 415/160
1428030 11/1968 Fed. Rep. of Germany ... 415/149 R
527881 4/1954 France ..... 415/149 R
364581 11/1962 Switzerland ..... 415/149 R
500965 2/1939 United Kingdom ..... 415/160

*Primary Examiner*—Robert E. Garrett
*Assistant Examiner*—Joseph M. Pitko
*Attorney, Agent, or Firm*—Antonelli, Terry & Wands

[57] ABSTRACT

A device for changing and attaching or mounting an angle of stationary vanes of an axial-flow fluid machine by rotating the stationary vanes through a circumferential movement of an intermediate cylinder. The device includes at least one arm secured to one end of the intermediate cylinder and engaging at a second end in a groove formed in a block member which is attached to an end of an actuator and is movable in a tangential direction of the intermediate cylinder. A guide arrangement is provided for guiding a movement of the block member and at least a portion of the actuator so as to ensure a smooth operation of the actuator by freeing the same from any influence of undesireable forces such as lateral pressure caused by a thermal expansion of the intermediate cylinder.

34 Claims, 5 Drawing Figures

VANE ANGLE CHANGING DEVICE FOR AN AXIAL FLUID MACHINE

The present invention relates to an axial-flow machine such as, for example, an axial-flow compressor, axial-flow turbine, or the like and, more particularly, to a vane angle changing device for an axial-flow machine, which device enables a changing of a mounting angle of stationary vanes for improving partial load operation characteristics or a widening of a range of operation of the axial-flow machine.

Vane angle changing devices for axial-flow compressors have been proposed wherein, in order to improve a partial load operation characteristic or a widening of a range of operation, the vane angle changing device receives a fluid dynamic force which is exerted on the stationary vanes by fluid flowing in the machine during operation thereof, as well as an external force produced by, for example, a power cylinder, for rotating the stationary vanes so as to overcome the fluid dynamic force, with the vane angle changing device being required to operate accurately under the application of such forces.

In, for example, Japanese Utility Model Publication No. 111747/1968, a vane angle changing device is proposed wherein stationary vane arms are fixed at one end thereof to shafts, hereinafter referred to as stationary vane shafts, with opposite ends of the vane arms being fixed to a ring disposed around an inner casing or to an intermediate cylinder. In operation, the ring or the intermediate cylinder is rotated in a circumferential direction so as to drive the stationary vane arms thereby rotating the stationary vanes.

Alternatively, in, for example, U.S. Pat. No. 3,860,355 and Japanese Patent Publication No. 22445/1977, it has been proposed to move the ring or intermediate cylinder in an axial direction so as to drive the stationary vane arms thereby rotating the stationary vanes.

In an arrangement wherein the ring or intermediate cylinder is moved axially, that is, an axial driving-type system, the stationary vane arms are disposed at a right angle to the axis of the rotor; whereas, in an arrangement wherein the ring or intermediate cylinder is rotated in a circumferential direction, that is, a rotational-type driving system, the stationary vane arms are disposed in an axial direction of the rotor.

A disadvantage of providing an axial driving-type system wherein the ring or intermediate cylinder is moved axially, resides in the fact that it is necessary to dispose axial driving power cylinders around the ring or the intermediate cylinder at positions opposed to each other across the rotor axis in order to attain a smooth axial sliding movement of the ring or the intermediate cylinder and, consequently, such a drive arrangement requires at least two power cylinders.

A further disadvantage of an axial driving type system resides in the fact that it is essential for the necessary power cylinders to exert an equal driving force or otherwise the necessary smooth axial sliding movement will not be obtainable due to local contact between the sliding parts. Furthermore, it is necessary for the power cylinders to exert the same level as the force necessary for rotating the stationary arm. Consequently, the axial driving type system requires a greater driving power than the rotational driving type system in which the ring or intermediate cylinder is rotated thereby resulting in a greater initial cost as well as an increase in subsequent operational cost.

On the other hand, a smooth driving can be effected with only one cylinder in a rotational driving type system since the radial distance between the point of application of the force generated by the power cylinder and the rotor axis can be selected to be greater than a distance between the stationary vane arms and the rotor axis. Thus, it is possible in a rotational driving type system, to rotate the stationary vanes at a reduced force exerted by the single power signal. Consequently, the rotational drive system is generally considered to be superior to that of the axial driving type system. Nevertheless, the rotational driving type system still suffers from a number of disadvantages.

More particularly, in a vane angle changing device of a rotational driving type system, generally the power cylinder mounted on the outer casing means is connected, as shown in the above-noted Japanese Utility Model Publication No. 11174/1968, to the intermediate cylinder by means of a link means. By virtue of this arrangement, a driving force can be resolved into a first force component which acts to push or pull the intermediate cylinder in a tangential direction and a second force component which pushes or pulls the intermediate cylinder in the direction perpendicular to the direction of the first force component, both of which are applied to the point of application of the intermediate cylinder. The second force component applied perpendicularly to the intermediate cylinder is as large as several hundred killograms when the compressor is a multistage compressor having, for example, five to six stages. The large force applied to the intermediate cylinder undesireably impairs the smooth operation of means for absorbing thermal expansion which, for example, in Japanese Utility Model Publication No. 11174/1968 is constructed as a cylinder supporting ring. Additionally, the second force component which is applied perpendicularly also applies a lateral pressure to a rod of the power cylinder to cause a local contact between the rod of the power cylinder and the cylinder thereby impeding a smooth operation of the power cylinder.

In the arrangement proposed in Japanese Utility Model Application No. 11174/1968, the lateral pressure acting on a power cylinder is also produced by virtue of the fact that the position of the point of connection between an end of the link means and the intermediate cylinder, with respect to the position of the power cylinder, is changed in an axial direction due to thermal distortion during an operation of the axial flow machine. Consequently, the rod of the power cylinder receives not only the lateral pressure produced by the perpendicular force component produced by the power cylinder but also the lateral pressure produced by a difference of the thermal expansion between the intermediate cylinder and the outer casing thereby resulting in an unsmooth operation of the power cylinder.

Yet another problem encountered in Japanese Utility Model No. 11174/1968, resides in the fact that, where the outer casing is divided into two halves along a horizontal plane, the power cylinder must be mounted on the lower half of the outer casing because, if the power cylinder is mounted on the upper half of the outer casing, it is impossible to connect the intermediate cylinder to the power cylinder and, consequently, an assembling of the apparatus is virtually impossible. Moreover, it is also necessary to dispose the power cylinder as close as possible to the split or joint surface of the outer casing in order to facilitate a connection of the power cylinder to the intermediate cylinder and such disposition is undesireable since it makes it impossible to space a point of connection between the intermediate cylinder and the link means from a center of the rotor. Consequently, the power cylinder would be required to exert a greater force.

The aim underlying the present invention essentially resides in providing a vane changing device for an axial-flow fluid machine which minimizes if not avoids the application of lateral pressure to an actuator such as a power cylinder for rotating an intermediate cylinder or ring of the axial-flow fluid machine thereby ensuring a smooth operation of the actuator.

In accordance with advantageous features of the present invention, at least one arm is attached to an intermediate cylinder or to a plurality of rings rotatably secured to the intermediate cylinder, with the at least one arm being extended toward the outer casing. A block means is adapted to be reciprocatingly displaced in a direction of the axis of the rotor of the axial flow fluid machine while being guided by a guide means on an inner surface of an outer casing. In order to drive the block means by the actuator, the block means and an end of the at least one arm are connected through an engaging portion which is adapted to transmit a force of the actuator to the arm or arms in a direction perpendicular to the rotor axis and engaging ends adapted to be inserted into the engaging portion in the radial direction of the rotor so as to be engaged by the engaging portion in a direction perpendicular to the rotor axis.

Advantageously, in accordance with the present invention, the actuator may be constructed as a power cylinder having a rod to which the block means is connected. Moreover, the engaging portion may include a groove formed in a portion of the block means adjacent to the intermediate cylinder, with the groove being adapted to receive ends of the arm or arms attached to the intermediate cylinder or plurality of rings.

The engagement between the block means and an end of each of the arms may, in accordance with the present invention, be attained through a substantially rectangular rotatable member carried by an end of the arm through a supporting member, a pin, and a spherical surface means and received by the groove in the block means.

The guide means may, according to the present invention, include a guide rod supported at both ends by a plurality of supports secured to another surface of the outer casing. Moreover, the guide means may include a guide plate disposed between the guide rod and the outer casing.

The axial flow fluid machine is generally provided with an inner casing and an outer casing disposed outside of the inner casing, with the intermediate cylinder being disposed between the inner casing and the outer casing. The rings for enabling a circumferential rotation are generally secured to the intermediate cylinder independently of each other or in a group corresponding to the respective stages of stationary vanes of the axial-flow machine. Axial grooves may be formed in an inner side of the rings, with the axial grooves being adapted to receive the ends of the stationary vane arms for rotating the stationary vanes of the fluid machine. The actuator is adapted to rotate the rings in a circumferential direction to change the mounting angle of the stationary vanes. The block means, adapted to be reciprocatingly displaced may, in accordance with the present invention, extend in an axial direction of the rotor at least over a region in which the arms are arrayed in the axial direction of the rotor. The engaging portion may be formed in either one of the block means or the other ends of the respective arms, with the engaging portion being adapted to transmit the force of the actuator to the respective arms in a direction perpendicular to the axis of the rotor.

The engaging end of the vane angle changing device of the present invention may be formed in the other of the block means and the opposite end of the respective arms, with the engaging end being adapted to be inserted into the groove in a radial direction of the rotor so as to be engaged by the rotor in a direction perpendicular to the axis of the rotor.

Accordingly, it is an object of the present invention to provide a vane angle changing device for axial-flow fluid machine which avoids, by simple means, shortcomings and disadvantages encountered in the prior art.

Another object of the present invention resides in providing a vane angle changing device for an axial-flow fluid machine which minimizes if not avoids an application of any lateral pressure attributable to thermal distortion to an intermediate cylinder of the axial-flow fluid machine.

Still another object of the present invention resides in providing a vane angle changing device for an axial-flow fluid machine which permits a mounting of an actuator of the device on an upper portion of an outer casing of the machine, which outer casing is divided along a horizontally extending plane into an upper casing portion and a lower casing portion.

A still further object of the present invention resides in providing a vane angle changing device for an axial-flow fluid machine which is simple in construction and therefore relatively inexpensive to manufacture.

A still further object of the present invention resides in providing a vane angle changing device for an axial-flow fluid machine which functions reliably under all operating conditions of the fluid machine.

These and other objects, features, and advantages of the present invention will become more apparent from the following description when taken in connection with the accompanying drawings which show, for the purposes of illustration only, several embodiments in accordance with the present invention, and wherein.

Figure 1:
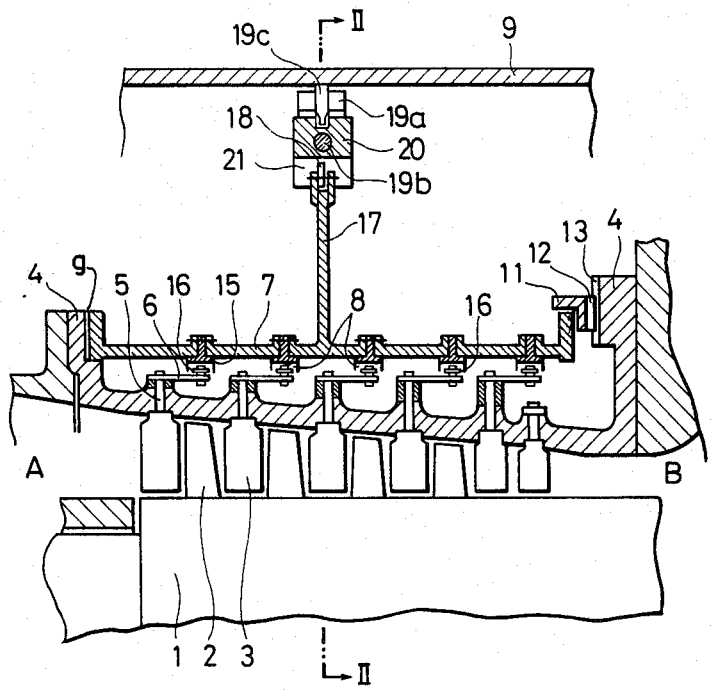
FIG. 1 is a vertical cross sectional view of a portion of a vane angle changing device constructed in accordance with the present invention.

Referring now to the drawings wherein like reference numerals are used throughout the various views to designate like parts and, more particularly, to FIGS. 1–4, according to these figures, an axial flow fluid machine such as, for example, a compressor, includes a rotor 1 carrying moving vanes 2 which convert a torque energy, supplied by a prime mover (not shown) to the rotor, into an angular momentum and delivers the latter to a fluid by compressing the fluid between the moving blades 2 and stationary vanes 3 rotatably adjustably secured to the inner casing 4 to establish a high static pressure of the fluid. The fluid to be compressed flows from an axial end designated A to an axial end designated B through a passage defined between an outer peripheral surface of the rotor 1 and an inner peripheral surface of the casing 4. The stationary vanes are rotatably carried by respective stationary vane shafts 5 to which are connected base ends of stationary vane arms 6.

Figure 2:
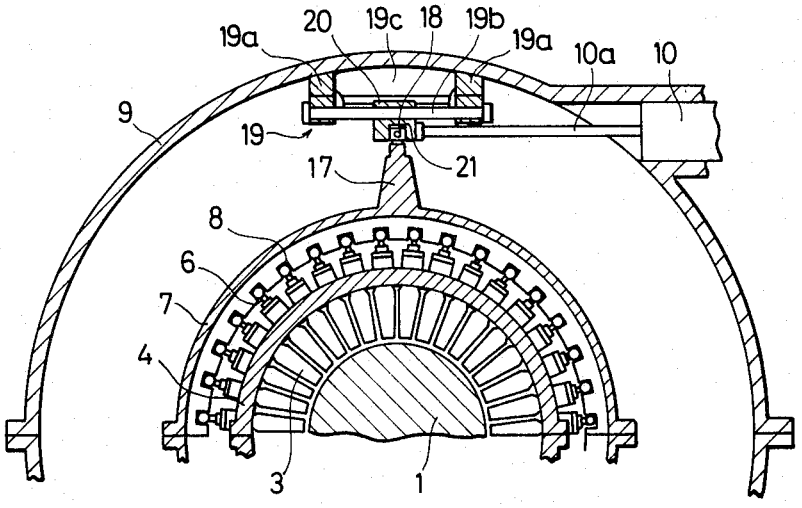
FIG. 2 is a cross sectional view taken along the line II—II in FIG. 1.

As shown most clearly in FIG. 2, outer ends of the stationary vane arms 6 are engaged by grooves formed or disposed along an inner side of the intermediate cylinder 7 and extending in an axial direction of the rotor. The intermediate cylinder 7 is rotatably mounted on an outer side of the inner casing 4 in such a manner so as to avoid any influence by thermal expansion of the inner casing 4. More specifically, at the axial end A, for example, a suction side of an axial compressor, the intermediate cylinder 7 is directly carried by the inner casing 4 with a slight gap g being provided between the end or terminal faces of the intermediate cylinder 7 and inner casing 4, while at the axial end B, for example, a discharge side of an axial flow compressor, the intermediate cylinder 7 is supported in a manner so as to absorb a difference between the thermal expansion of the intermediate cylinder 7 and the inner casing 4.

More particularly, as shown in FIG. 1, the intermediate cylinder 7 is supported by a support ring 11 having radial projections which are received in radial grooves 13 formed in the inner casing 4. The intermediate cylinder 7 is divided, in an axial direction, into a plurality of segments which are integrated or joined through rings by, for example, suitable fasteners such as bolts or the like. The axially extending grooves 8, adapted to receive the outer ends of the stationary vane arm 6 for rotating the stationary vanes 3, are formed along the inner peripheral surfaces of the rings 15.

The stationary vane arms 6 are provided at their ends with, for example, ball joints 16, adapted to be slidably accommodated in the grooves 8. An arm 17 is adapted to rotate the rings 15, and therewith the grooves 8 in a circumferential direction as a unit with the intermediate cylinder 7 since the arm 17 is secured to the outer surface of the intermediate cylinder 7. The arm 17 is extended toward the outer casing 9 and is provided at a free end thereof with, for example, a rotatable joint member 18. According to the illustrated arrangement, it is possible to rotate the intermediate cylinder 7 by applying to the end of the arm 17 a force perpendicular to the rotor axis, that is, a tangential force, so that the stationary vane arms 6 are moved along the grooves 8 through the action of the rings 15 to rotate the stationary vane shafts 5 thereby changing the angle of the stationary vanes as desired.

To apply a tangential force to the end of the arm 17, as shown in FIG. 2, the outer casing 9 is provided, along an inner surface thereof, with a guide means generally designated by the reference numeral 19 formed, for example, by a guide rod or bar 19*b* supported at both ends by two two supports 19*a*, 19*a* and a guide plate 19*c* interposed between the guide rod or bar 19*b* and the outer casing 9. A block means 20 is mounted for reciprocating movement while being guided by the guide means 19. The block means 20 is connected to an actuator such as, for example, a piston rod 10*a* of a power cylinder 10 secured to the outer casing 9 so as to be driven by the power cylinder 10. The block means 20 is provided, at a portion adjacent to the intermediate cylinder, with an engaging portion for transmitting the power of the power cylinder 10 in an axial direction of the rotor 1 and, for this purpose, for example, a groove 21 may be provided which extends in an axial direction of the rotor 1.

Figure 3:
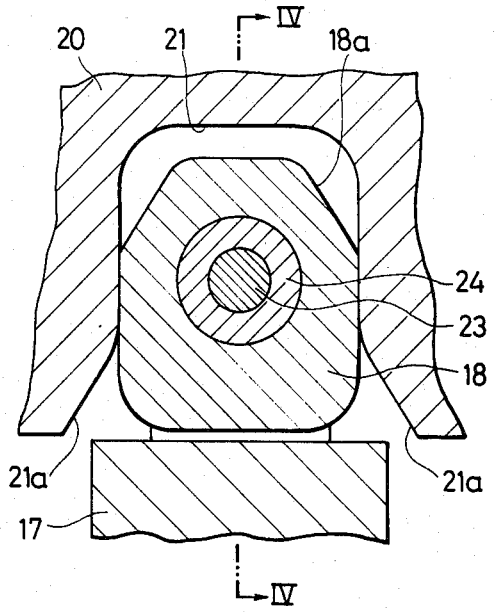
FIG. 3 is a cross sectional view, on an enlarged scale, illustrating an engagement between a block means and an arm in the vane angle changing device of the present invention.

As shown most clearly in FIG. 3, the groove 21 is adapted to receive the rotatable joint member 18 secured to the end of the arm 17. The guide bar or rod 19*b* of the guide means 19 extends, as shown in FIG. 2, through the block means 20 and, since the block means 20 is guided at its upper portion by the guide plate 19*c*, the block means 20 is allowed to make a linear movement only in an axial direction of the power cylinder 10. The arrangement is such that a line of application of a load to the block means 20 by the piston rod 10*a* of the power cylinder 10 substantially coincides with a center of the rotatable member 18 on the end of the arm 17 in order to further ensure a smooth reciprocatory motion of the block means 20.

Figure 4:
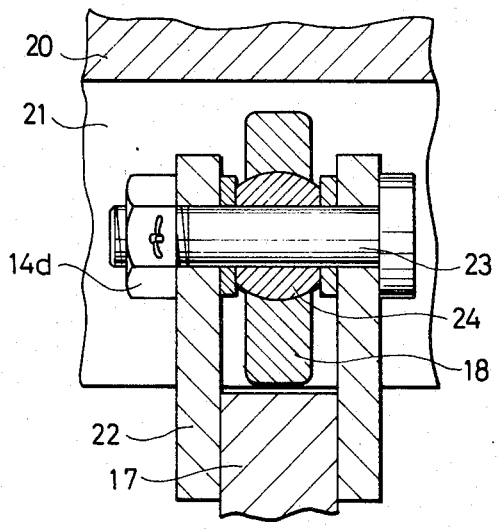
FIG. 4 is a cross sectional view taken along the line IV—IV in FIG. 3.

The mutual engagement between the end of the arm 17 and the block means 20 is shown most clearly in FIGS. 3 and 4 and, according to these figures, the rotatable joint member 18, which has a substantially rectangular form, is secured to the end of the arm 17 through a supporting member 22, pin 23, and spherical member 24. Therefore, the rotatable joint member 18 is allowed to rotate in any desired direction along the spherical seat of the spherical member 24 around the pin 23. As shown in FIG. 3, the rotatable joint member 18 includes a slanted surface portion 18*a*, and an inlet area of the groove 21 formed in the block means 20 is provided with a corresponding slanted surface portion 21*a* so as to facilitate an insertion of the rotatable joint member 18 into the groove 21. A position of a centroid of the rotatable joint member 18 is offset to a lower side, that is, toward the axis of the rotor 1, so that the movable member 18 is maintained parallel to the groove 21 during the insertion thereof into the groove 21. Therefore, it is possible to easily attain the engagement between the arm 17 and the block means 20 simply by fitting the outer casing 9 from the upper side thereof. Namely, according to the invention, it is possible to attain the mutual engagement between the power cylinder 10 and the intermediate cylinder 7 without using any connecting pin simply by fitting the outer casing 9.

In an actual assemblying of the axial flow compressor, the parts such as the power cylinder 10, guide means 19, block means 20, and so forth are attached to the inner surface of the upper portion of the outer casing 9 beforehand so as to locate the block means 20 as a position corresponding to the end of the arm 17. After an assemblying of the rotor, the inner casing 4, the intermediate cylinder 7, and so forth, the upper portion of the outer casing 9 is fitted in order to complete the assemblying operation of the axial flow compressor.

The axial flow compressor described hereinabove in connection with FIGS. 1–4 operates in the following manner:

A lift is applied to each stationary vane 3 as the vane 3 increases the static pressure of the fluid. As a result, a torque is generated in the stationary vane shafts 5 because the point of application of the lift is offset from the axis of the stationary vane shafts 5. This torque appears during the operation of the axial flow compressor as the tangential force acting on the intermediate cylinder 7 so that it is necessary to apply a counter force balancing the tangential force to the intermediate cylinder by means of the power cylinder 10 to thereby hold the stationary vanes 3 at any desired angle.

To change the angle of the stationary vanes 3 of the axial flow compressor from the operational state shown in FIG. 2, the force exerted by the power cylinder 10 on the intermediate cylinder 7 is increased to rotate the intermediate cylinder by a desired angle. Namely, the movement of the power cylinder 10 is transmitted to the block means 20 through the piston rod 10*a* of the power cylinder 10 so that the block 20 moves in a direction perpendicular to the axis of the rotor 1 while being guided by the guide means 19 secured to the outer casing 9. The movement of the block means 20 causes a rotation of the arm 17 engaged therewith in the direction of movement of the block means 20 so that the intermediate cylinder 7, rotatable with respect to the inner casing 4, is rotated together with the arm 17. Consequently, the stationary vanes 3 are rotated by the desired angle through the operation of the grooves 8, stationary vane arms 6, and stationary vane shafts 5.

In the above-described embodiment, the joint member 18 on the end of the arm is slidable relative to the groove 21 and the block means 20 both in a vertical direction and in an axial direction so that a difference in the thermal expansion between the outer casing 9 and the intermediate cylinder 7 is advantageously absorbed or compensated for. The block means 20 is guided by the guide means of the outer casing 9 only in a direction perpendicular to the axis of the rotor 1. Therefore, no lateral pressure is applied to the power cylinder rod 10*a* and, consequently, a smooth operation of the power cylinder 10 is ensured as well as a reliable operation of the vane angle changing device. Thus, in the vane angle changing device of the present invention, the end of the arm 17 receives only the force for driving the intermediate cylinder in the direction perpendicular to the axis of the rotor 1 to ensure a smooth sliding motion of the intermediate cylinder 7, even when there is a difference in the thermal expansion between the intermediate cylinder 7 and the outer casing 9 or when the axis of the intermediate cylinder 7 is offset from or inclined with respect to the axis of the rotor 1.

Since the mutual engagement between the block means and the arm 17 is attained through the engagement between the groove 21 in the block means 20 and the movable joint member 18 on the end of the arm 17, it is not necessary to use any pin for connecting the intermediate cylinder 7 to the outer casing 9. Thus, in the above described embodiment, the arm 17 is of a sufficient length so as to terminate in a position near the outer casing 9 so that the point of application of the tangential force for rotating the intermediate cylinder 7 is spaced sufficiently from the latter. The tangential force required for rotating the intermediate cylinder 7 is in inverse proportion to the distance between the point of application of the tangential force and the rotor axis. As noted above, in previously proposed devices, in which the intermediate cylinder 7 is connected to the power cylinder 10 by means of a link mechanism and a pin, the point of application of the tangential force for rotating the intermediate cylinder has to be located at a position near the outer periphery of the intermediate cylinder 7. Therefore, in the above described embodiment of the present invention, it is possible to reduce the force of the actuator or power cylinder 10 required for rotating the intermediate cylinder 7 as compared with previously proposed devices. For example, in an axial flow compressor, with a vane angle changing device of the present invention, it is possible to reduce the power of the cylinder 10 to a level of two-thirds to three-quarters of previous devices and, consequently, to lower not only production cost but also the operation costs.

Although, in the embodiment described hereinabove, the means for rotating the intermediate cylinder 7, that is, the power cylinder or actuator 10, is mounted on the upper portion of the outer casing 9, the power cylinder or actuator 10 may, in accordance with the present invention, also be mounted on the lower portion of the outer casing 9. When the actuator or power cylinder 10 is mounted on the lower portion of the outer casing 9, it is possible to easily attain an engagement between the movable joint member 18 and the block means 20 as in the case of the above described embodiment, by off-setting the position of the centroid of the rotary joint member 18 to the lower side of the axis of the pin 23, that is, towards the lower side of the casing.

In the above-described embodiment of FIGS. 1–4, the movable joint member has a substantially rectangular form so as to be able to make a surface contact with the groove 21. However, it is also possible in accordance with the present invention for the movable joint member 18 to have a cylindrical form. When the movable joint member 18 has a cylindrical form, the engagement between the movable joint member 18 and the groove 21 can be attained more easily, but the stress in Herts is increased due to a line contact between the movable joint member 18 and the groove 21 so that the movable joint member 18 and the block means 20 may be worn down or damaged over a shorter period of time thereby impairing the overall reliability of the axial-flow compressor.

Figure 5:
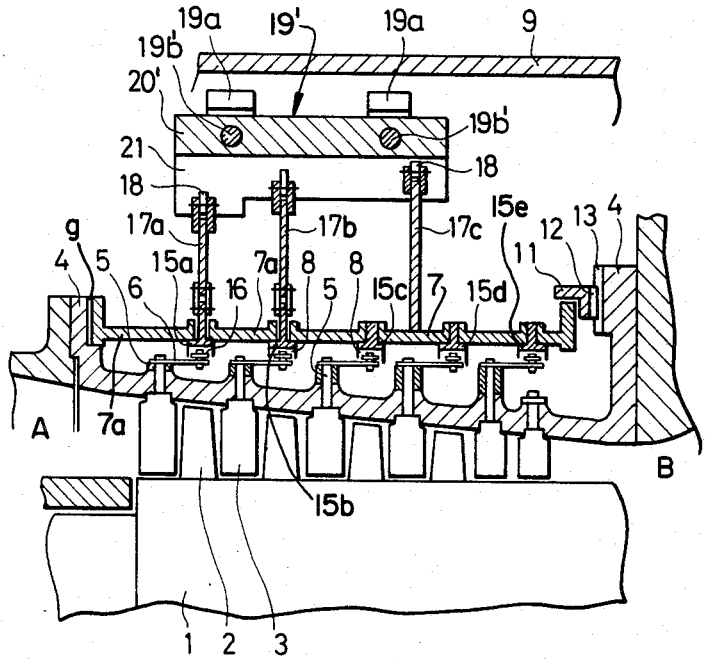
FIG. 5 is a vertical cross sectional view of a portion of another embodiment of a vane angle changing device constructed in accordance with the present invention.

As shown in FIG. 5, it is also possible to provide for the stationary vanes of different stages to be adjusted at different angles with respect to each other. As in the construction of the embodiment of FIGS. 1–4, the intermediate cylinder 7 is secured to the outer side of the inner casing 4 so as to absorb any difference resulting from a thermal expansion therebetween. Rings 15*a*–15*e*, rotatable in the circumferential direction, are disposed on the inner side of the intermediate ring 7 at positions corresponding to the respective stages of the stationary vanes 3. Axially extending grooves 8 for receiving the ends of the stationary vane arm 6 so as to enable a rotating of the stationary vanes 3 of the respective stages are formed in the inner peripheral surfaces of the respective rings 15*a*–15*e*, with the rings 15*a*–15*e* being provided on respective axial segments of the intermediate cylinder 7, which segments are coupled by suitable fastening such as, for example, bolts or the like. Two axial segments 7*a*, 7*b* of the intermediate cylinder 7, adjacent to the inlet side A of the axial flow machine, i.e., the suction side of a compressor, are respectively provided with two rings 15*a*, 15*b*, with the rings 15*a*, 15*b* being connected to arms 17*a*, 17*b*, which are spaced from one another in an axial direction of the rotor 1 and which extend in a direction toward the outer casing 9. On the other hand, the remaining three rings 15*c*, 15*d*, 15*e*, adjacent to the outlet side B, i.e., a discharge side of a compressor, are fixed to a portion of the intermediate cylinder 7 to which is connected an arm 17*c*, axially spaced from the arms 17*a*, 17*b* and extending in a direction toward the outer casing 9. Of the arms 17*a*, 17*b*, 17*c*, the arm 17*a*, nearest to the inlet side A of the axial flow machine has the smallest length, while the arm 17*c* adjacent to the outlet side B of the axial flow machine has the greatest length. A block means 20', similar to the block means 20, extends in an axial direction of the rotor 1 and includes a groove 21 also extending in an axial direction of the rotor 1. The block means 20' is adapted to be reciprocatingly displaced in a direction perpendicular to the direction of the axis of the rotor 1. The groove 21 in the block means 20' receives the free ends of the arms 17*a*, 17*b*, 17*c*. Since the arm 17*a*, nearest the inlet side A, has the smallest length, while the arm 17*c*, adjacent the outlet side B has the greatest length, the depth of the groove 21 is the greatest at the end portion of the block means 20' adjacent to the inlet side A and smallest at the end portion nearest to the outlet side B of the axial flow machine so that the rotatable members 18 on the respective arms 17*a*, 17*b*, 17*c* can engage the groove 21 under optimum conditions.

Alternatively, the groove 21 may have a constant depth but be inclined along the length of the block means 20' in accordance with the respective lengths of the arms 17*a*, 17*b*, 17*c*, because the groove 21 is required only to engage the ends of the arms 17*a*–17*c* of the respective stages of the compressor. The block means 20' is adapted to move reciprocatingly in a direction perpendicular to the axis of the rotor 1 while being guided by a guide means generally designated by the reference numeral 19', which guide means is similar to the guide means shown in FIG. 2.

In the embodiment of FIG. 5, since the block means 20' extends in the axial direction of the rotor 1, it is preferred to provide two guide rods 19*b'* which correspond to the guide rods 19, for forming the guide means 19' in order to stably guide the block means 20'. As in the case of the embodiment of FIGS. 1–4, the block means 20' is driven by a single power cylinder (not shown) secured to the upper portion of the outer casing 9. In all other respects the embodiment of FIG. 5 essentially corresponds to the embodiment of FIGS. 1–4.

In addition to the advantages offered by the embodiment of FIGS. 1–4, the embodiment of FIG. 5 offers a further advantage in that the groove 21 in the block means 20', extending in the axial direction of the rotor 1, receives the ends of the arms 17*a*, 17*b*, 17*c*, having different lengths, in such a manner that the stationary vanes 3 of the respective stages associated with the arms 17*a*–17*c* are adjusted to different optimum angles simultaneously to thereby improve the performance of the axial flow fluid machine.

In the embodiment of FIG. 5, the rings 15*c*, 15*d*, 15*e*, corresponding to the third to fifth stationary vanes 3, are fixed to the intermediate cylinder 7 so that the three rings 15*c*, 15*d*, 15*e* are rotated as a unit. However, as can readily be appreciated, this arrangement is merely illustrated and the present invention clearly does not exclude an arrangement in which the rings corresponding to all of the stages are arranged for independent rotation to permit independent control of the respective stages of the stationary vanes 3.

In both of the embodiments described hereinabove, the connection between the block means 20 or 20' and the arms 17 or 17*a*–17*c* is attained through a mutual engagement between a groove 21 formed in the block means 20 or 20' and the ends of the arms 17 or 17*a*–17*c* received by the groove 21. Clearly, the same advantage may be attained by an arrangement whereby engaging portions such as, for example, grooves are formed in the ends of the respective arms 17 or 17*a*–17*c*, while the block means 20 or 20' are provided with projections or the like adapted to be received by the grooves. Moreover, the engaging portion need not always be a groove but other constructions or configurations such as, for example, a rectangular configuration may be employed as an engaging means, provided that it permits an insertion of an end of an associated member by a movement in a radial direction of the rotor 1 to achieve the connection between the engaging portion and the end of the associated member in a direction perpendicular to the direction of the axis of the rotor 1. It is to be noted also that the described construction of the guide means 19 is not exclusive and, for example the guide means can guide any portion of the piston rod 10*a* of the power cylinder 10 provided that the block means 20 or 20' is integrally fixed to the end of the piston rod 10*a* of the power cylinder 10. In the above described embodiments it is also possible to use, as an actuator for reciprocatingly driving the block means 20 or 20' in the direction perpendicular to the rotor axis, any other desired actuator such as, for example, a combination of a rotary actuator formed of a motor and a worm gear, in place of a power cylinder 10.

As described hereinabove, in the vane angle changing device of the present invention for an axial-flow fluid machine, it is possible to perfectly avoid the application of lateral pressure to the actuator 10 for producing the force for rotating the stationary vanes 3, so that the actuator 10 is allowed to operate stably and smoothly to thereby ensure a highly realiable operation of the vane angle changing device.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A vane angle changing device for an axial-flow fluid machine having a rotor means, an inner casing means, an outer casing means disposed exteriorly of said inner casing means, a rotatably mounted intermediate cylinder means disposed between said inner and outer casing means, stationary vane means, means for rotatably mounting said stationary vane means for enabling a selective adjustment of a mounting angle of the stationary vane means, an actuator means for rotating said intermediate cylinder means, the vane angle changing device comprising:

at least one arm means having a first end connected to said intermediate cylinder means;

a first means adapted to be selectively reciprocated in a direction substantially perpendicular to a longitudinal center axis of the rotor means for transmitting an adjusting force to said intermediate cylinder means;

second means formed in one of said first means and a second end of said at least one arm means for transmitting the force from said first means to said at least one arm means in a direction substantially perpendicular to the longitudinal center axis of the rotor means; and third means formed in the other of said first means and the second end of said at least one arm means adapted to be inserted in said second means in a radial direction of said rotor means for effecting a connection of said at least one arm means to said first means.

2. A vane angle changing device according to claim 1, wherein guide means are provided for guiding a movement of said first means and at least a portion of said actuator means.

3. A vane angle changing device according to claim 2, wherein said guide means and said actuator means are mounted on said outer casing means.

4. A vane angle changing device according to claim 3, wherein said actuator means includes a power piston-cylinder means including a piston rod means connected to said first means.

5. A vane angle changing device according to claim 4, wherein said second means includes a groove means formed in a portion of said first means for receiving the second end of said at least one arm means.

6. A vane angle changing device according to claim 2, wherein said guide means includes at least one guide rod having said first means mounted thereon, said guide rod being supported at respective ends thereof by support means secured to an inner surface of said outer casing means.

7. A vane angle changing device according to claim 6, wherein said guide means further includes a guide plate means disposed between said guide rod and said outer casing means.

8. A vane angle changing device according claim 1, wherein said actuator means includes a power piston-cylinder means including a piston rod means connected to said first means.

9. A vane angle changing device according to claim 1, wherein said second means includes a groove means formed in a portion of said first means for receiving the second end of said at least one arm means.

10. A vane angle changing device according to claim 1, wherein said outer casing means is divided into an upper and lower casing portion, and wherein said actuator means is mounted on said upper casing portion.

11. A vane angle changing device according to claim 1, wherein said outer casing means is divided into an upper and lower casing portion, and wherein said actuator means is disposed on said lower casing portion.

12. A vane angle changing device according to claim 1, wherein said means for mounting said stationary vane means includes a plurality of groove means provided along an inner peripheral surface of said intermediate cylinder means and extending in an axial direction thereof, said groove means being adapted to accommodate arm means for adjusting a mounting angle of the stationary vane means.

13. A vane angle changing device according to claim 1, wherein said intermediate cylinder means is divided, in an axial direction thereof, into a plurality of individual segments, ring means are interposed between the individual segments for interconnecting said segments to each other, said means for rotatably mounting said stationary vane means includes a plurality of groove means provided along an inner peripheral surface of the respective ring means, a stationary vane arm means interposed between the respective stationary vane means and said groove means, and means accommodated in said groove means for connecting respective first ends of said stationary vane means to said ring means.

14. A vane angle changing device according to claim 13, wherein said means for connecting respective first ends of said stationary vane arm means to said ring means includes a ball joint means.

15. A vane angle changing device according to claim 1, wherein said second means transmits the force from said first means to said at least one arm means in a direction substantially perpendicular to the longitudinal center axis of the rotor means while permitting relative movement of the first means and said at least one arm means in a direction substantially parallel to the longitudinal center axis of the rotor means so that a difference in thermal expansion between the outer casing means and the intermediate cylinder means can be compensated for.

16. A vane angle changing device according to claim 1, wherein said second means includes a groove means extending in a direction substantially parallel to the longitudinal center axis of the rotor means, said third means being inserted in said groove means and movable therein in a direction substantially parallel to the longitudinal center axis of the rotor means so that a difference in the thermal expansion between the outer casing means and the intermediate cylinder means can be compensated for.

17. A vane angle changing device according to claim 1, wherein said third means is movable in said second means both in the radial direction and in a direction substantially parallel to the longitudinal center axis of the rotor so that a difference in thermal expansion between the outer casing means and the intermediate cylinder means can be compensated for.

18. A vane angle changing device for an axial-flow fluid machine having a rotor means, an inner casing means, an outer casing means disposed exteriorily of said inner casing means, a rotatably mounted intermediate cylinder means disposed between said inner and outer casing means, stationary vane means, means for rotatably mounting said stationary vane means for enabling a selective adjustment of a mounting angle of the stationary vane means, and an actuator means for rotating said intermediate cylinder means, the vane angle changing device comprising:

at least one arm means having a first end connected to said intermediate cylinder means;

a first means adapted to be selectively reciprocated in a direction substantially perpendicular to a longitudinal center axis of the rotor means for transmitting an adjusting force to said intermediate cylinder means;

second means formed in one of said first means and a second end of said at least one arm means for transmitting the force from said first means to said at least one arm means in a direction substantially perpendicular to the longitudinal center axis of the rotor means, said second means includes a groove means formed in a portion of said first means for receiving the second end of said at least one arm means;

guide means for guiding a movement of said first means and at least a portion of said actuator means, said guide means and said actuator means are mounted on said outer casing means, said actuator means includes a power piston-cylinder means including a piston rod means connected to said first means; and third means formed in the other of said first means and the second end of said at least one arm means adapted to be inserted in said second means in a radial direction of said rotor means for effecting a connection of said at least one arm means to said first means, said third means includes a substantially rectangular member adapted to be inserted into said groove means, support means for mounting said substantially rectangular member on said second end at least one arm means including a pin means and spherical means for enabling a rotatably support of said substantially rectangular member in said groove means.

19. A vane angle changing device according to claim 18, wherein said guide means includes at least one guide rod having said first means mounted thereon, said guide rod being supported at respective ends thereof by support means secured to an inner surface of said outer casing means.

20. A vane angle changing device according to claim 19, wherein said guide means further includes a guide plate means disposed between said guide rod and said outer casing means.

21. A vane angle changing device according to claim 20, wherein said first means is a substantially block-shaped member.

22. A vane angle changing device according to claim 21, wherein said outer casing means is divided into an upper and lower casing portion, and wherein said guide means and said actuator means are mounted on said upper casing portion.

23. A vane angle changing device according to claim 22, wherein said outer casing means is divided into an upper and lower casing portion and wherein said guide means and said actuator means are mounted on said lower casing portion.

24. A vane angle changing device for an axial-flow fluid machine having a rotor means, an inner casing means, an outer casing means disposed exteriorly of said inner casing means, a rotatably mounted intermediate cylinder means disposed between said inner and outer casing means, stationary vane means, means for rotatably mounting said stationary vane means for enabling a selective adjustment of a mounting angle of the stationary vane means, and an actuator means for rotting said intermediate cylinder means, the vane angle changing device comprising:

at least one arm means having a first end connected to said intermediate cylinder means;

a first means adapted to be selectively reciprocated in a direction substantially perpendicular to a longitudinal center axis of the rotor means for transmitting an adjusting force to said intermediate cylinder means;

second means formed in one of said first means at a second end of at least one arm means for transmitting the force from said first means to said at least one arm means in a direction substantially perpendicular to the longitudinal center axis of the rotor means, said second means includes a groove means formed in a portion of said first means for receiving the second end of said at least one arm means; and third means formed in the other of said first means in the second end of said at least one arm means adapted to be inserted in said second means in a radial direction of said rotor means for effecting a connection of said at least one arm means to said first means, said third means includes a substantially rectangular member adapted to be inserted into said groove means, support means for mounting said substantially rectangular member on the second end of said at least one arm means including a pin means and a spherical means for enabling a rotatable support of said substantially rectangular member in said groove means.

25. A vane angle changing device for an axial-flow fluid machine having a rotor means, an inner casing means, an outer casing means disposed exteriorly of said inner casing means, a rotatably mounted intermediate cylinder means disposed between said inner and outer casing means, stationary vane means, means for rotatably mounting said stationary vane means for enabling a selective adjustment of a mounting angle of the stationary vane means, and an actuator means for rotating said intermediate cylinder means, the vane angle changing device comprising:

at least one arm means having a first end connected to said intermediate cylinder means;

a first means adapted to be selectively reciprocated in a direction substantially perpendicular to a longitudinal center axis of the rotor means for transmitting an adjusting force to said intermediate cylinder means;

second means formed in one of said first means and a second end of said at least one arm means for transmitting the force from said first means to said at least on means in a direction substantially perpendicular to the longitudinal center axis of the rotor means;

third means formed in the other of said first means and the second end of at least one arm means adapted to be inserted in said second means in a radial direction of said rotor means for effecting a connection of said at least one arm means to said first means;

a plurality of ring means mounted on said intermediate cylinder means for rotation independently of each other, said ring means being respectively associated with predetermined stages of the axial-flow fluid machine; and wherein a plurality of arm means are provided and are spaced from each other over a predetermined axial length of the intermediate cylinder means, a first end of respective ones of said arm means being connected to said intermediate cylinder means by said ring means, and said first means extends in an axial direction of said intermediate cylinder means for a distance at least equal to the predetermined axial length of said intermediate cylinder means over which the arm means are spaced.

26. A vane angle changing device according to claim 25, wherein said second means includes a groove means formed in a portion of said first means for receiving the respective second ends of said plurality of arm means.

27. A vane angle changing device according to claim 26, wherein said third means includes a substantially rectangular member adapted to be inserted into said groove means, a support means for mounting said substantially rectangular member on the second ends of said plurality of arm means including a pin means and a spherical means for enabling a rotatable support of said substantially rectangular member in said groove means.

28. A vane angle changing device according to claim 26, wherein guide means are provided for guiding a movement of said first means and at least a portion of said actuator means.

29. A vane angle changing device according to claim 25, wherein said intermediate cylinder means is divided into a plurality of individual cylindrical segments, said ring means are respectively interposed between the individual cylindrical segments and secured thereto, each of said arm means are connected to said ring means in such a manner that at least one of a group of stationary vane means or a single stationary vane means is selectively adjusted in response to an actuation by said actuator means.

30. A vane angle changing device according to claim 29, wherein said second means includes a groove means formed in a portion of said first means for receiving the second end of said at least one arm means.

31. A vane angle changing device according to claim 30, wherein said arm means are each of a different length, and wherein said groove means has a varying depth corresponding to a respective length of said arm means.

32. A vane angle changing device according to claim 31, wherein guide means are provided for guiding a movement of said first means and at least a portion of said actuator means.

33. A vane angle changing device according to claim 32, wherein said guide means includes at least two spaced guide rods having said first means mounted thereon, each of said guide means being supported at respective ends thereof by support means secured to an inner surface of said outer casing means.

34. A vane angle changing device according to claim 33, wherein said guide means further includes a guide plate means disposed between said guide rod and said outer casing means.

* * * * *